US010154715B2

(12) United States Patent
Wang

(10) Patent No.: US 10,154,715 B2
(45) Date of Patent: Dec. 18, 2018

(54) WATERPROOF CONTAINER

(71) Applicant: Hudson Wang, Kaohsiung (TW)

(72) Inventor: Hudson Wang, Kaohsiung (TW)

( * ) Notice: Subject to any disclaimer, the term of this patent is extended or adjusted under 35 U.S.C. 154(b) by 206 days.

(21) Appl. No.: 15/256,776

(22) Filed: Sep. 6, 2016

(65) Prior Publication Data

US 2017/0071305 A1 Mar. 16, 2017

(30) Foreign Application Priority Data

Sep. 16, 2015 (CN) ..... 2015 1 0587223

(51) Int. Cl.
*A45C 13/00* (2006.01)
*A45C 13/10* (2006.01)
*A45C 11/20* (2006.01)

(52) U.S. Cl.
CPC ..... *A45C 13/008* (2013.01); *A45C 11/20* (2013.01); *A45C 13/103* (2013.01)

(58) Field of Classification Search
CPC ..... A45C 13/008; A45C 11/20; A45C 13/103
See application file for complete search history.

(56) References Cited

U.S. PATENT DOCUMENTS 3,141,536 A * 7/1964 Fulton ..... A45C 13/103 190/119
3,203,517 A * 8/1965 Stein ..... A45C 13/36 112/419
8,777,045 B2 * 7/2014 Mitchell ..... A45C 11/20 220/592.2
9,422,099 B2 * 8/2016 Mitchell ..... A45C 11/20
2002/0130131 A1 9/2002 Zucker et al.
2005/0279123 A1 * 12/2005 Maldonado ..... A45C 5/02 62/457.7
2006/0118376 A1 * 6/2006 Godshaw ..... A01K 1/0254 190/107
2010/0155437 A1 * 6/2010 Broadbent ..... A45C 11/20 224/148.1

OTHER PUBLICATIONS

Search Report appended to an Office Action issued to Chinese counterpart application No. 201510587223.7 by the SIPO dated Apr. 4, 2018.

* cited by examiner

*Primary Examiner* — Tri Mai
(74) *Attorney, Agent, or Firm* — McNees Wallace & Nurick LLC

(57) ABSTRACT

A waterproof container includes a bag unit, a seat unit and a cover unit. The seat unit includes a receiving seat that is disposed on the bag unit and that defines an opening. The cover unit removably and sealingly covers the opening, and includes a cover and a zipper. The zipper divides the cover into a fixed portion that is connected fixedly to the receiving seat, and a flip portion that corresponds in position to the opening. The cover is operable between a flipped state, where the zipper is unzipped and the flip portion is flipped open for exposing the opening, and a non-flipped state, where the zipper is zipped for covering the opening with the flip portion.

11 Claims, 8 Drawing Sheets

WATERPROOF CONTAINER

CROSS-REFERENCE TO RELATED APPLICATION

This application claims priority of Chinese Patent Application No. 201510587223.7, filed on Sep. 16, 2015.

FIELD

The disclosure relates to a waterproof container, more particularly to a waterproof container that has thermal insulation and watertight sealing properties.

BACKGROUND

Referring to FIG. 1, a conventional waterproof container 1 includes an inner foam layer 11, an outer bag 12 surrounding the inner foam layer 11, a cover 13 connected to a top end of the outer bag 12 and covering the outer bag 12, a foam pad 14 enclosed in the cover 13, and a zipper 15 interconnecting the outer bag 12 and the cover 13. The inner foam layer 11 and the foam pad 14 provide thermal insulation and prevent water from entering or exiting the waterproof container 1.

However, since the inner foam layer 11 and the foam pad 14 are not fixedly connected to each other, and since the inner foam layer 11, the outer bag 12, the cover 13 and the foam pad 14 are all made of soft and pliable materials, the conventional waterproof container 1 is susceptible to deform when an external force is exerted thereon, and a gap may be formed between the outer bag 12 and the cover 13. As a result, entry of water into the waterproof container 1 and entry of heat into or dissipation of heat out of the waterproof container 1 may occur through the gap or when the zipper 15 is unzipped, thereby adversely affecting the thermal insulation and waterproof properties of the conventional waterproof container 1.

SUMMARY

Therefore, an object of the disclosure is to provide a waterproof container that can alleviate at least one of the aforesaid drawbacks of the prior art.

According to the disclosure, the waterproof container includes a bag unit, a seat unit and a cover unit.

The bag unit defines an accommodating space. The seat unit includes a receiving seat that is disposed on a top end of the bag unit and that defines an opening in spatial communication with the accommodating space. The cover unit removably and sealingly covers the opening. The cover unit includes a cover and a zipper. The cover covers the receiving seat. The zipper is disposed on the cover, and divides the cover into a fixed portion that is connected fixedly to the receiving seat, and a flip portion that corresponds in position to the opening. The cover is operable between a flipped state, where the zipper is unzipped and the flip portion is flipped open for exposing the opening, and a non-flipped state, where the zipper is zipped for covering the opening with the flip portion.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
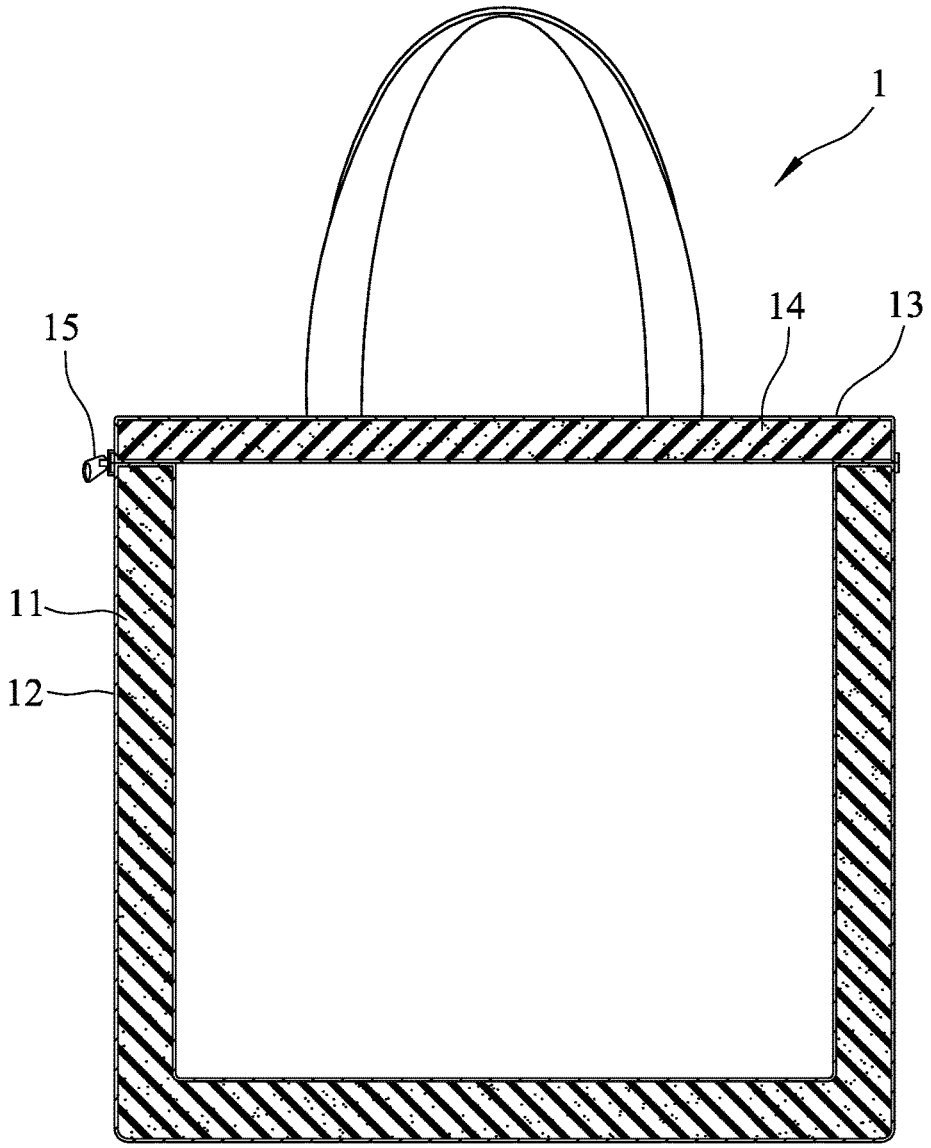
FIG.1 PRIOR ART
FIG. 1 is a sectional view of a conventional waterproof container.
Figure 2:
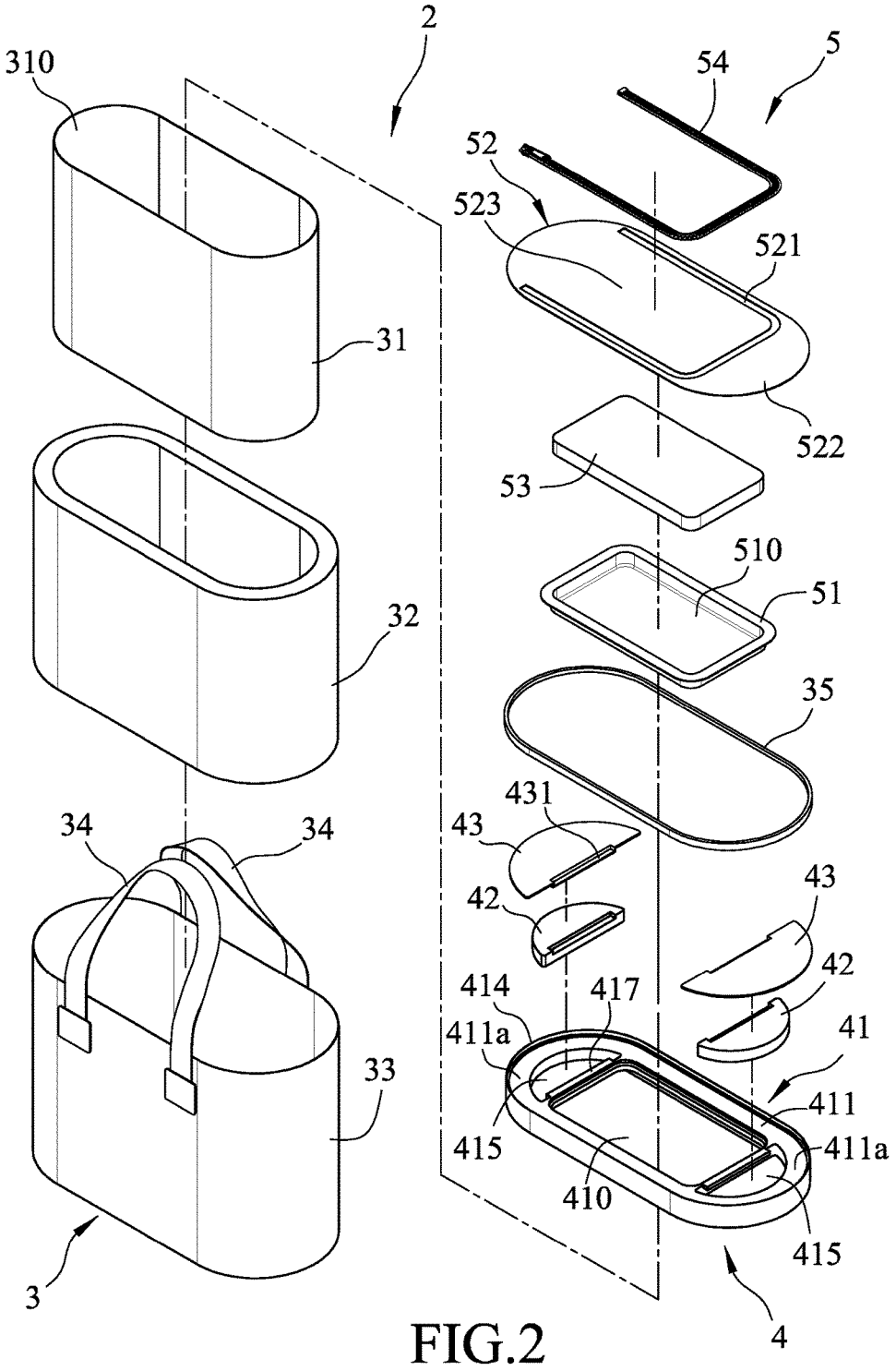
FIG. 2 is an exploded perspective view of an embodiment of a waterproof container according to the disclosure.
Figure 3:
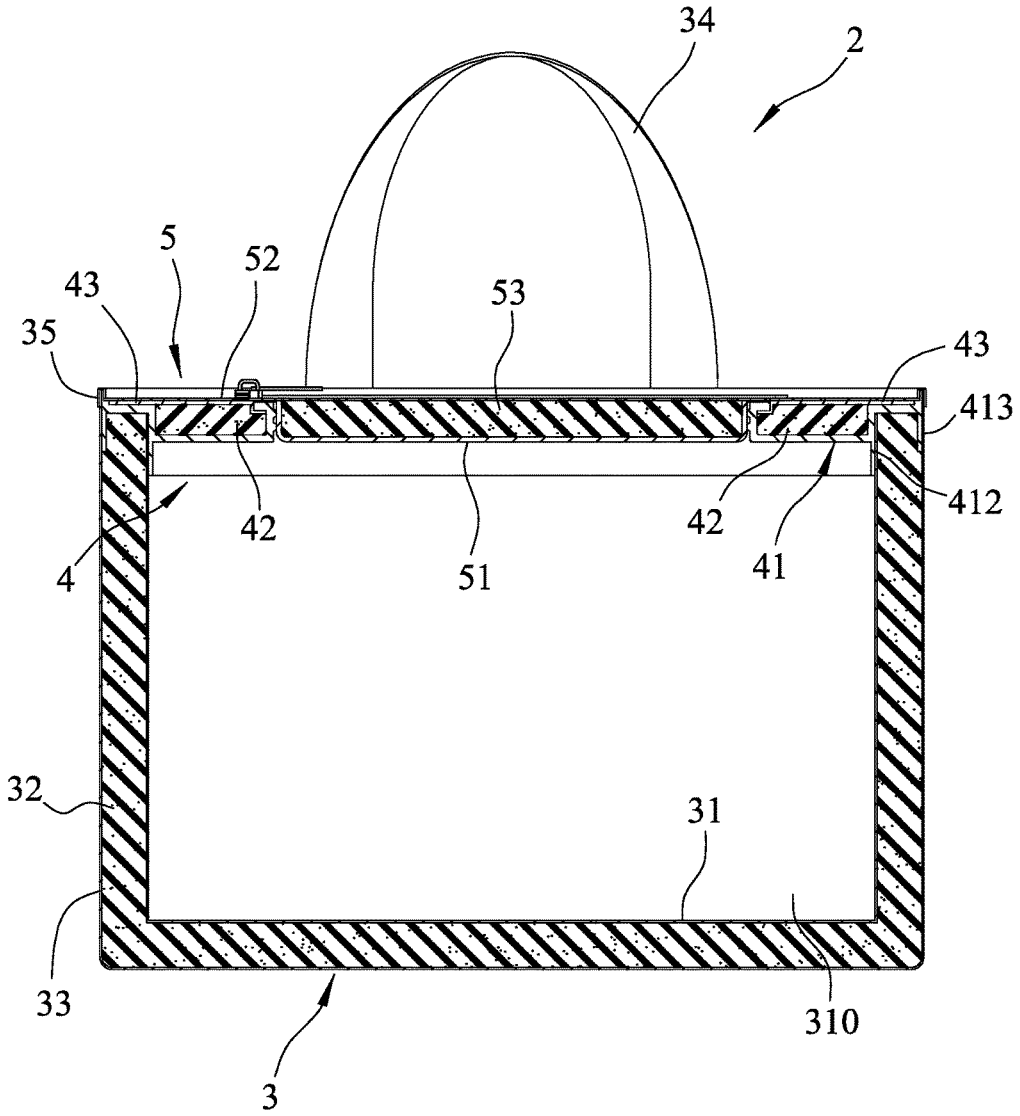
FIG. 3 is a sectional view of the embodiment.

Referring to FIGS. 2 and 3, an embodiment of a waterproof container 2 according to the disclosure includes a bag unit 3, a seat unit 4, a positioning frame 35 and a cover unit 5.

The bag unit 3 includes an inner bag 31, a waterproof layer 32, an outer bag 33 and two handling straps 34. The inner bag 31 defines an accommodating space 310. The waterproof layer 32 surrounds the inner bag 31 and is made of a foam material. The outer bag 33 surrounds the waterproof layer 32 and is made of fabric. The handling straps 34 are fixedly connected to the outer bag 33, e.g., by sewing.

The seat unit 4 includes a receiving seat 41, two waterproof pads 42 that are made of a foam material, and two retaining plates 43.

Figure 4:
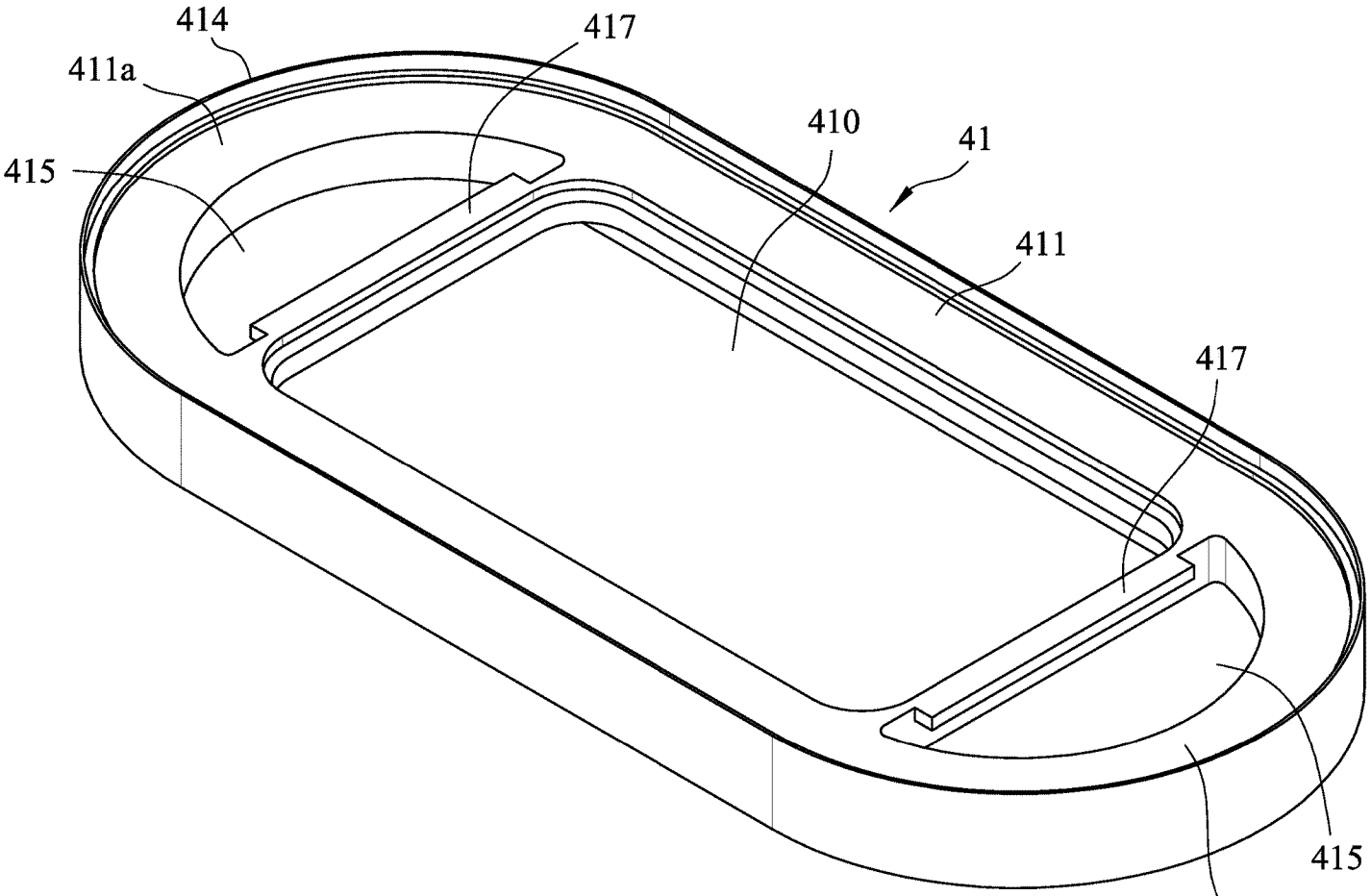
FIG. 4 is a top perspective view of the embodiment, showing a receiving seat.

The receiving seat 41 is disposed on top ends of the inner bag 31 and the waterproof layer 32, and defines an opening 410 in spatial communication with the accommodating space 310. As shown in FIGS. 2, 3 and 4, the receiving seat 41 includes a seat body 411 that has two side portions 411*a* respectively located at two opposite sides of the opening 410 and that cover a portion of the accommodating space 310. Each of the side portions 411*a* of the seat body 411 is formed with a pad-receiving groove 415 that receives a respective one of the waterproof pads 42 therein. Each of the retaining plates 43 covers a respective one of the pad-receiving grooves 415 for retaining a corresponding one of the waterproof pads 42 within the respective one of the pad-receiving grooves 415.

Figure 7:
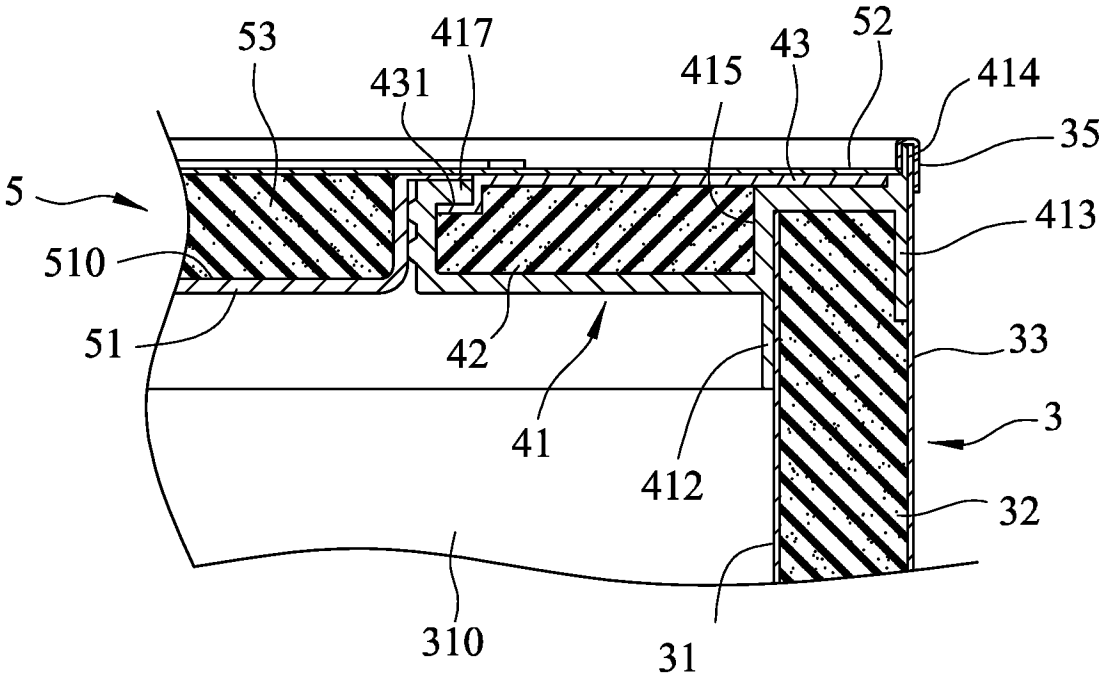
FIG. 7 is a fragmentary enlarged sectional view of FIG. 3, illustrating an assembly of the receiving seat, a bag unit and a cover unit.

Referring to FIGS. 2, 4 and 7, in this embodiment, each of the retaining plates 43 has a retaining portion 431, and the receiving seat 41 further includes two flange portions 417 each of which extends from a respective one of the side portions 411*a* of the seat body 411 into a respective one of the pad-receiving grooves 415, and each of which is disposed above and abuts against the retaining portion 431 of a respective one of the retaining plates 43 so as to retain a respective one of the waterproof pads 42 in the respective one of the pad-receiving grooves 415.

Figure 5:
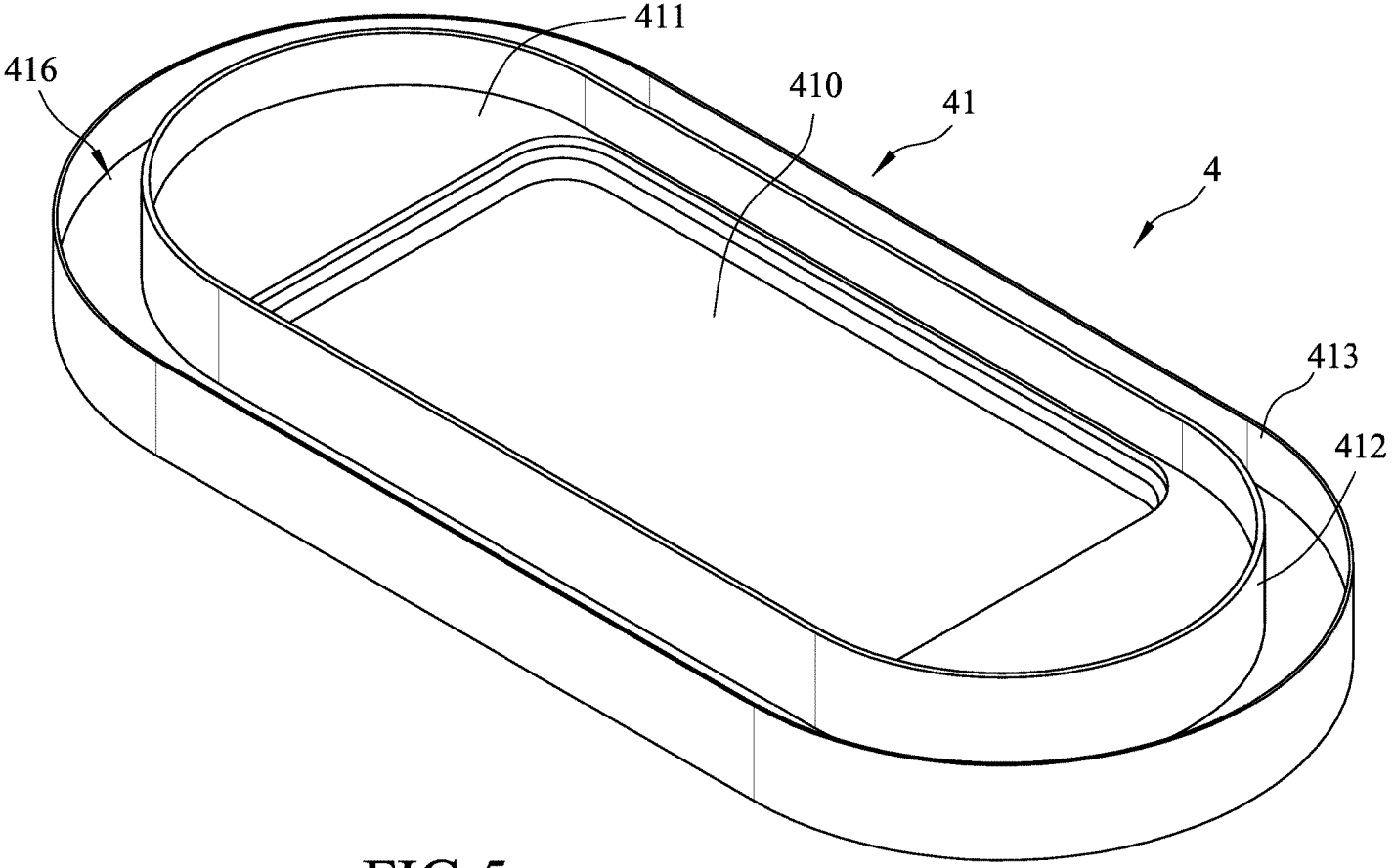
FIG. 5 is a bottom perspective view of the receiving seat shown in FIG. 4.
Figure 6:
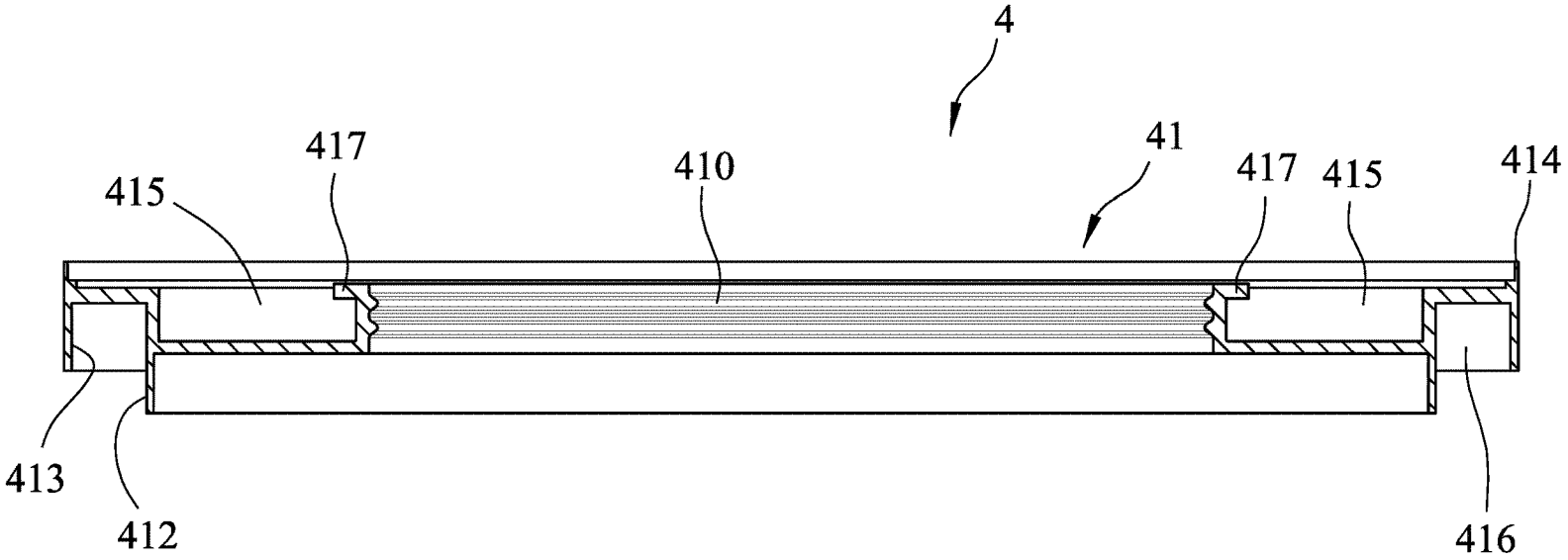
FIG. 6 is a sectional view of the receiving seat shown in FIG. 4.

With further reference to FIGS. 5, 6 and 7, in this embodiment, the receiving seat 41 further includes a lower extension wall 413, a positioning wall 412 and an upper extension wall 414. The lower extension wall 413 extends downwardly from an outer periphery of the seat body 411. The positioning wall 412 extends downwardly from the seat body 411, is spaced apart from the lower extension wall 413, and cooperates with the lower extension wall 413 and the seat body 411 to define an engaging groove 416 that engages the top ends of the inner bag 31 and the waterproof layer 32.

The upper extension wall 414 extends upwardly from the outer periphery of the seat body 411 and is opposite to the lower extension wall 413.

As best shown in FIG. 7, the inner bag 31 of the bag unit 3 is fixedly connected to the positioning wall 412 using heat sealing. The outer bag 33 of the bag unit 3 is attached onto outer surfaces of the lower and upper extension walls 413, 414, and has a top end that is flush with a top end of the upper extension wall 414. The positioning frame 35 is securely coupled to the top ends of the outer bag 33 and the upper extension wall 414. It should be noted that, the heights of the lower extension wall 413, the positioning wall 412 and the upper extension wall 414 may be identical or different. In certain embodiments, the lower extension wall 413 and the positioning wall 412 may extend downwardly from the seat body 411 by one inch, and the upper extension wall 414 may extend upwardly from the seat body 411 by one inch.

Figure 8:
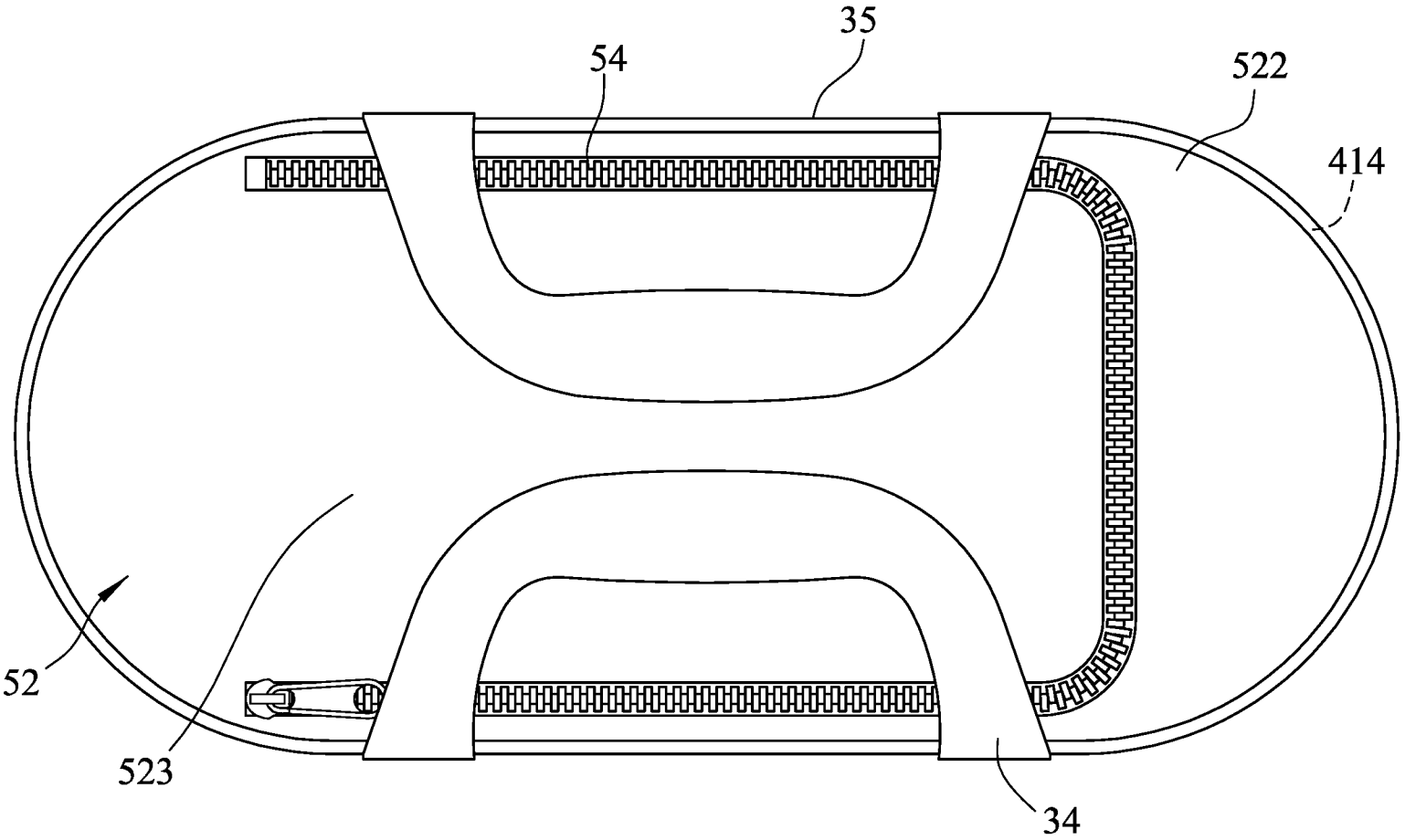
FIG. 8 is a top view of the embodiment.

Referring to FIGS. 2, 3 and 8, the cover unit 5 removably and sealingly covers the opening 410 of the receiving seat 41, and includes a cover 52, a zipper 54, a tray 51 and a waterproof block 53.

The cover 52 covers the seat body 411 of the receiving seat 41 and is surrounded by the upper extension wall 414 of the receiving seat 41. The cover 52 includes a zipper-receiving portion 521.

The zipper 54 is substantially U-shaped, is disposed on the zipper-receiving portion 521 of the cover 52, and divides the cover 52 into a flip portion 523 and a fixed portion 522. The flip portion 523 corresponds in position to the opening 410 of the receiving seat 41 and is surrounded by the zipper 54. The fixed portion 522 corresponds in position to the side portions 411*a* of the seat body 411, is connected fixedly to a top surface of the receiving seat 41, and surrounds the flip portion 523. The cover 52 is operable between a flipped state, where the zipper 54 is unzipped and the flip portion 523 is flipped open for exposing the opening 410, and a non-flipped state, where the zipper 54 is zipped for covering the opening 410 with the flip portion 523.

The tray 51 removably covers the opening 410, and defines a receiving space 510.

The waterproof block 53 is received fixedly in the receiving space 510 of the tray 51, and is fixed onto the flip portion 523 of the cover 52, so that the tray 51 covers and closes the opening 410 of the receiving seat 41 when the cover 52 is in the non-flipped state. In this embodiment, the tray 51 is press fitted into the opening 410 of the receiving seat 41 when the cover 52 is in the non-flipped state. For instance, the tray 51 and the opening 410 may differ in size by, but not limited to, 1 millimeter, for enabling the tray 51 to be press fitted into the opening 410.

When storing an article (not shown) in the waterproof container 2, the zipper 54 is first unzipped, and then the flip portion 523 of the cover 52 is flipped open so as to remove the tray 51 from the opening 410 of the receiving seat 41. After the article is placed into the accommodating space 310 through the opening 410, the tray 51 is press fitted back into the opening 410 and the zipper 54 is zipped so that the cover 52 is back to the non-flapped state and covers the opening 410.

It should be noted that the cover 52 can be made of fabric or a rigid material. The zipper-receiving portion 521 of the cover 52 is configured as a through hole that extends through top and bottom surfaces of the cover 52.

In this embodiment, the tray 51 is made of an elastic material such as rubber, and the receiving seat 41 is made of a rigid material so as to ensure a proper interference fit between the tray 51 and the opening 410 of the receiving seat 41. Alternatively, the tray 51 may be made of a rigid material, and the receiving seat 41 may be made of an elastic material, with no particular restrictions.

To sum up, the waterproof layer 32, the waterproof pads 42 and the waterproof block 53 provide thermal insulation and waterproof properties for the waterproof container 2 of the present disclosure. The configuration of the receiving seat 41 and interference fit between the tray 51 and the opening 410 prevent formation of a gap between the bag unit 3 and the cover unit 5 so as to provide a watertight seal for the waterproof container 2.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A waterproof container comprising:

a bag unit defining an accommodating space;

a seat unit including a receiving seat that is disposed on a top end of said bag unit and that defines an opening in spatial communication with said accommodating space; and a cover unit removably and sealingly covering said opening, said cover unit including a cover that covers said receiving seat, and a zipper that is disposed on said cover and that divides said cover into a fixed portion connected fixedly to said receiving seat, and a flip portion corresponding in position to said opening, said cover being operable between a flipped state, where said zipper is unzipped and said flip portion is flipped open for exposing said opening, and a non-flipped state, where said zipper is zipped for covering said opening with said flip portion;

wherein said seat unit further includes two waterproof pads, said receiving seat having two side portions respectively located at two opposite sides of said opening, each of said side portions being formed with a pad-receiving groove that receives a respective one of said waterproof pads therein; and wherein said seat unit further includes two retaining plates each covering a respective one of said pad-receiving grooves for retaining a corresponding one of said waterproof pads within the respective one of said pad-receiving grooves.

2. The waterproof container as claimed in claim 1, wherein: said cover unit further includes a tray that removably covers said opening, and that defines a receiving space, and a waterproof block that is received fixedly in said receiving space of said tray, and that is fixed onto said flip portion of said cover, so that said tray covers and closes said opening of said receiving seat when said cover is in the non-flipped state.

3. The waterproof container as claimed in claim 2, wherein said tray is press fitted into said opening when said cover is in the non-flipped state.

4. The waterproof container as claimed in claim 3, wherein said zipper is substantially U-shaped, said flip portion of said cover being surrounded by said zipper, said fixed portion of said cover surrounding said flip portion and being fixed to a top surface of said receiving seat.

5. The waterproof container as claimed in claim 1, wherein each of said retaining plates has a retaining portion, said receiving seat further including two flange portions, each of said flange portions extending from a respective one of said side portions of said receiving seat into a respective one of said pad-receiving grooves, and disposed above and abutting against said retaining portion of a respective one of said retaining plates so as to retain a respective one of said waterproof pads in the respective one of said pad-receiving grooves.

6. The waterproof container as claimed in claim 1, wherein said bag unit includes an inner bag defining said accommodating space, a waterproof layer surrounding said inner bag, and an outer bag surrounding said waterproof layer.

7. The waterproof container as claimed in claim 6, wherein said receiving seat of said seat unit further includes a seat body, a lower extension wall extending downwardly from an outer periphery of said seat body, and a positioning wall extending downwardly from said seat body, being spaced apart from said lower extension wall, and cooperating with said lower extension wall and said seat body to define an engaging groove that engages top ends of said inner bag and said waterproof layer.

8. The waterproof container as claimed in claim 7, wherein said receiving seat further includes an upper extension wall extending upwardly from said outer periphery of said seat body, said outer bag of said bag unit being attached onto outer surfaces of said lower and upper extension walls.

9. The waterproof container as claimed in claim 8, further comprising a positioning frame securely coupled to top ends of said outer bag and said upper extension wall.

10. The waterproof container as claimed in claim 9, wherein said bag unit further includes two handling straps fixedly connected to said outer bag.

11. The waterproof container as claimed in claim 1, wherein said receiving seat has two side portions respectively located at two opposite sides of said opening and covering a portion of said accommodating space.

* * * * *